United States Patent [19]

Melconian

[11] Patent Number: 4,702,073

[45] Date of Patent: Oct. 27, 1987

[54] VARIABLE RESIDENCE TIME VORTEX COMBUSTOR

[76] Inventor: Jerry O. Melconian, 76 Beaver Rd., Reading, Mass. 01867

[21] Appl. No.: 838,165

[22] Filed: Mar. 10, 1986

[51] Int. Cl.[4] ..... F02C 3/14

[52] U.S. Cl. ..... 60/39.464; 60/732; 60/748; 60/755

[58] Field of Search ..... 60/39.36, 39.37, 39.464, 60/732, 733, 748, 750, 755, 756

[56] References Cited

U.S. PATENT DOCUMENTS

| | | | |
|---|---|---|---|
| 1,591,679 | 7/1926 | Hawley | 60/39.464 |
| 2,616,256 | 11/1952 | Davy et al. | 60/39.464 |
| 3,808,802 | 5/1974 | Tanasawa | 60/755 |
| 3,859,786 | 1/1975 | Azelborn et al. | 60/748 |
| 4,006,589 | 2/1977 | Schirmer | 60/748 |
| 4,040,251 | 8/1977 | Heitmann et al. | 60/39.36 |
| 4,054,028 | 10/1977 | Kawaguchi | 60/732 |
| 4,260,367 | 4/1981 | Markowski et al. | 60/742 |
| 4,316,878 | 2/1982 | Akune et al. | 110/238 |
| 4,429,538 | 2/1984 | Sato et al. | 60/748 |
| 4,545,196 | 10/1985 | Mongia et al. | 60/733 |

*Primary Examiner*—Louis J. Casaregola

*Attorney, Agent, or Firm*—Joseph S. Iandiorio; Douglas E. Denninger

[57] ABSTRACT

A variable residence time vortex combustor including a primary combustion chamber for containing a combustion vortex, and a plurality of louvres peripherally disposed about the primary combustion chamber and longitudinally distributed along its primary axis. The louvres are inclined to impel air about the primary combustion chamber to cool its interior surfaces and to impel air inwardly to assist in driving the combustion vortex in a first rotational direction and to feed combustion in the primary combustion chamber. The vortex combustor also includes a second combustion chamber having a secondary zone and a narrowed waist region in the primary combustion chamber interconnecting the output of the primary combustion chamber with the secondary zone for passing only lower density particles and trapping higher density particles in the combustion vortex in the primary combustion chamber for substantial combustion.

19 Claims, 5 Drawing Figures

VARIABLE RESIDENCE TIME VORTEX COMBUSTOR

RIGHTS IN INVENTION

This invention was made with Government support under contract No. DE-ACO2-84ER80210 awarded by the Department of Energy. The Government has certain rights in this invention.

FIELD OF INVENTION

This invention relates to a multichamber vortex combustor and more particularly to such a combustor which provides variable residence time to achieve complete combustion of fuel particles.

BACKGROUND OF INVENTION

A number of combustors are configured to enhance combustion by inducing one or more vortices of fuel particles entrained in air. To varying degrees, however, each of these combustors is plagued with problems of variable fuel particle size, uniform residence time, and cooling of the interior surfaces of the combustor.

Fuel particles are typically distributed over a size range inside the combustor. The large-sized particles experience the same residence time in conventional combustors as do smaller particles; the time is often insufficient to completely combust these larger fuel particles except within the peak power range of the combustor. The efficiency of most combustors noticeably decreases outside their peak power ranges.

It is desirable to operate combustors at high pressures to increase the efficiency of the combustors. However, cooling problems increase as the pressure increases since compressed air burns hotter than at atmospheric pressure. Some combustors develop internal temperatures of 4000° F. or more which would melt their surfaces if directly contacted by those temperatures. Typically, the outer surface of the combustor is cooled with air circulating around the combustor before the air is introduced into the combustor. In many combustors, cooling steps are provided which introduce air in a direction parallel to the interior surface of the combustor to induce a blanket of air which insulates the interior surface from the combustion gases. However, often 40% of the air introduced into a combustor is used for cooling and not for combustion. The large volume of air required for cooling causes a poor combustion exit temperature distribution which in turn requires additional cooling of the turbines.

Tanasawa, U.S. Pat. No. 3,808,802, describes a vortex combustor which burns fuel-air mixture in a central, forced vortex zone of a first cylindrical combustion chamber and in the outer natural vortex zone of a second cylindrical combustion chamber. There are a number of differences between combustors as taught by Tanasawa and variable residence time combustors according to this invention, described infra, e.g., control of fuel particle residence time, presence of louvres in the vicinity of primary combustion, control of the combustion vortex, and cooling of internal surfaces.

After fuel particles are combusted within primary and secondary combustion zones in conventional combustors, the combustion gases are cooled in a dilution zone in which air is provided to dilute the combustion gases. When a solid fuel such as coal is burned, ash and other by-product particulates are said from the system using a scroll, also known as a cyclone separator, that is presently positioned downstream of the dilution zone.

SUMMARY OF INVENTION

It is therefore an object of this invention to provide an improved multichamber vortex combustor which establishes a variable residence time for fuel particles.

It is a further object of this invention to provide such a vortex combustor which traps higher density fuel particles to ensure fragmentation and combustion of the particles.

It is a further object of this invention to provide such a vortex combustor which more fully utilizes combustion air to cool internal surfaces of the combustor.

It is a further object of this invention to provide such a vortex combustor which preheats the combustion air on the internal surfaces and drives a vortex with the preheated combustion air.

It is a further object of this invention to provide such a vortex combustor which enables tailoring of the vortex to adjust residence time for fuel particles of different densities.

It is a further object of this invention to provide such a vortex combustor which enables tailoring of the vortex to optimize combustion.

A still further object of this invention is to provide such a vortex combustor which can subsequently counteract the vortex to straighten the flow of combustion gases.

Yet another object of this invention is to provide such an improved vortex combustor which provides uniformly high combustion efficiency throughout its power range.

It is a further object of this invention to provide such a vortex combustor that can eliminate ash and other by-products directly from the primary combustion chamber of the combustor.

This invention results from the realization that a truly effective vortex combustor can be achieved by distributing a plurality of louvres both peripherally about a primary combustion chamber and longitudinally along its primary axis to impel air about the chamber to cool its interior surfaces and inwardly to tailor and assist in driving a combustion vortex in the primary combustion chamber and to feed combustion, and by interconnecting the primary combustion chamber to a second combustion chamber with a narrowed waist region which in cooperation with air impelled by the louvres passes only lower density particles and traps higher density particles in the combustion vortex for substantial to complete combustion.

This invention features a variable residence time vortex combustor. There are a primary combustion chamber for containing a combustion vortex and a plurality of louvres peripherally disposed about the primary combustion chamber and longitudinally distributed along its primary axis. The louvres are inclined to impel air about the primary combustion chamber to cool its interior surfaces and to impel air inwardly to assist in driving the combustion vortex in a first rotational direction and to feed combustion in the primary combustion chamber. There is also a second combustion chamber including a secondary zone and the primary combustion chamber further includes a narrowed waist region, interconnecting the output of the primary combustion chamber with the secondary zone, for passing only lower density particles and trapping higher density particles in the combustion vortex in the primary combustion chamber for substantial combustion.

In one embodiment the louvres are inclined in predetermined relationship with each other to optimize the combustion vortex such as to center and condense the combustion vortex radially about and longitinally along the primary axis of the primary combustion chamber. Substantially all of the louvres may be oriented to introduce air in the first rotational direction.

In a preferred embodiment the secondary zone includes a plurality of apertures inclined to drive air about the second combustion chamber in a second rotational direction to cool its interior surfaces, to resist the continuance of the combustion vortex beyond the waist region in the first rotational direction, and to assist in cooling combustion gases. The second chamber further includes a dilution zone, downstream of the secondary zone, having a plurality of inlets inclined radially inward for delivering air to further cool the combustion gases. The air entering the second combustion chamber from the dilution inlets may be directed to disburse the combustion vortex and convert air flow through the dilution zone to an axial flow. The vortex combustor may further include a plurality of passages for delivering air to cool the surfaces of the waist region and to further feed combustion. The primary combustion chamber may further include scrolling means, disposed circumferentially about its exterior surfaces and communicating with the interior of the primary combustion chamber, for removing ash and other by-products developed during combustion. The scrolling means may communicate with the interior at a position in the primary combustion chamber radially spaced from the vortex axis.

In another embodiment the primary combustion chamber is generally spherical and further includes means for introducing fuel into the combustion vortex such as a fuel injector and an air swirler for entraining fuel in air to form a fuel-air mixture deliverable to the combustion vortex. The primary combustion chamber further includes an ignitor for igniting the fuel-air mixture and the louvres of the primary combustion chamber are spaced about the entire surface of the primary combustion chamber, exclusive of the area occupied by the fuel injector, air swirler, and the ignitor. The vortex combustor is capable of combusting a mixture of fuel compounds as the fuel and the second combustion chamber is generally cylindrical.

DISCLOSURE OF PREFERRED EMBODIMENT

Other objects, features and advantages will occur from the following description of a preferred embodiment and the accompanying drawings, in which.

This invention may be accomplished by a multichamber vortex combustor which has a primary combustion chamber containing a number of louvres distributed both peripherally about the primary combustion chamber and longitudinally along its primary axis. When the combustor is immersed in pressurized air the louvres impel air about the interior of the chamber to cool its interior surfaces and impel air inwardly to assist in driving a combustion vortex. The air tailors the combustion vortex as determined by the orientation of the louvres. The primary combustion chamber is connected to a secondary zone of a second combustion chamber by a narrowed waist region which cooperates with air impelled by the louvres to pass only lower density particles while trapping higher density particles in the combustion vortex for fragmentation and substantial combustion of those particles.

In one construction, the secondary zone includes a number of apertures which are inclined to drive air tangentially about a second combustion chamber in a radial rotational direction opposite to the rotation of the combustion vortex to cool the interior surfaces of the second combustion chamber, to inhibit rotation of the combustion vortex beyond the waist region and to assist in cooling the combustion gases. The second chamber may further include a dilution zone downstream of the secondary zone which has a number of inlets inclined radially inward to further cool the combustion gases, to disperse the combustion vortex, and to convert flow of combustion gases through the dilution zone to an axial flow.

The primary combustion chamber in this construction includes a fuel injector and an axial or radial air swirler for entraining the fuel in air. Variable residence time vortex combustors according to this invention are well-suited for combusting a mixture of fuel compounds as the fuel. For fuels including coal or coal-oil mixtures, the primary combustion chamber may further include a scroller disposed circumferentially about its exterior surface and communicating with the interior to remove ash and other by-products developed during combustion.

Figure 1:
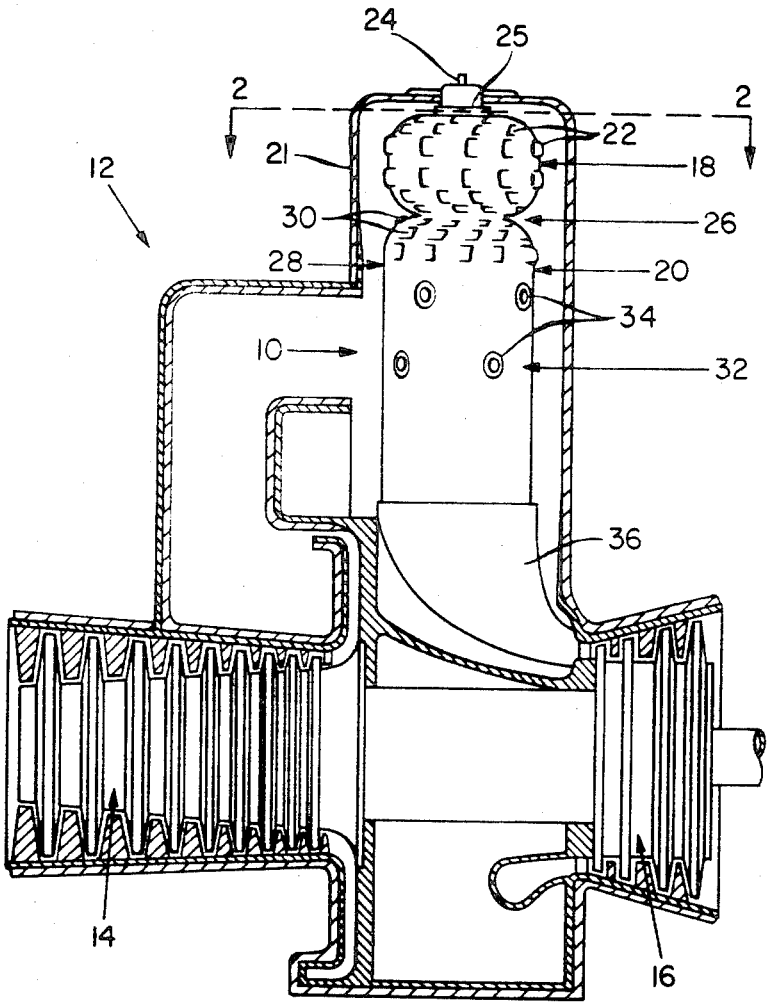
FIG. 1 is a cross-sectional elevational view of a turbine engine including a compressor, a vortex combustor according to this invention, and a turbine.

Variable residence time vortex combustor 10, FIG. 1, is shown as a component of gas turbine engine 12 in cooperation with compressor 14 and turbine 16. Compressor 14 immerses combustor 10, including primary combustion chamber 18 and secondary combustion chamber 20, in pressurized air within engine casing 21. Louvres 22 are fixed tangential slots which impel air about primary chamber 18 in a counter-clockwise direction as viewed in FIG. 2. Fuel is introduced by fuel injector 24 and entrained in air by air swirler 25, FIG. 1. The fuel-air mixture is delivered to a combustion vortex established within primary combustion chamber 18. As described infra, higher density particles are trapped for substantial to complete combustion before passing through waist region 26 to secondary zone 28.

Secondary zone 28 includes apertures 30 which are inclined to impel air in a clockwise direction to counteract continuance of the combustion vortex beyond waist region 26. Secondary combustion chamber 20 further includes dilution zone 32 in which inlets 34 are inclined radially inward to further stabilize flow of the combustion gases before they enter exhaust conduit 36. Air impelled by inlets 34 also determines where the hottest portion of the exhaust gases will strike the blades of turbine 16.

Figure 2:
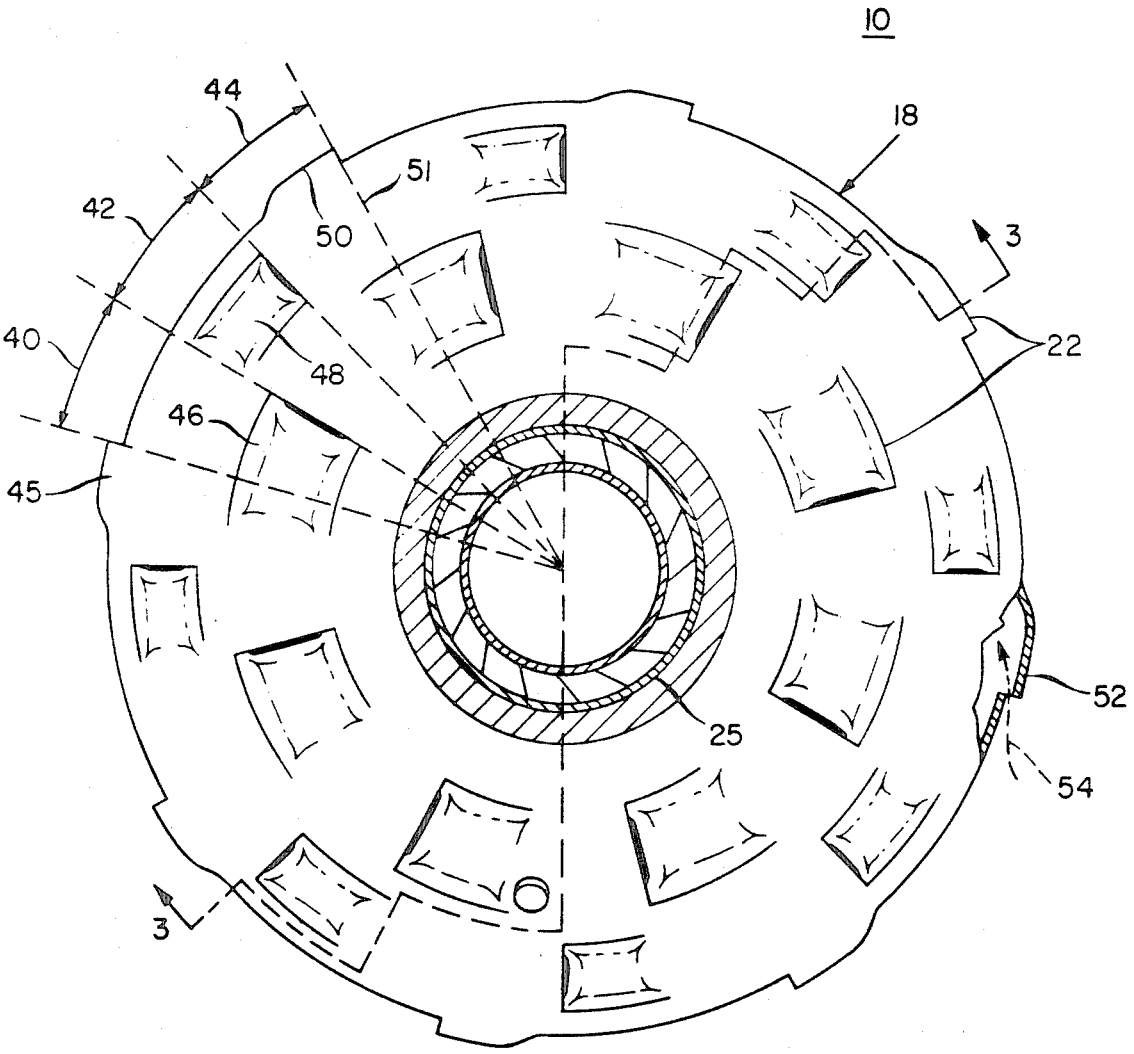
FIG. 2 is an end view of the combustor with the engine casing removed and the air swirler shown in section along lines 2—2 of FIG. 1.

The distribution of louvres 22 about primary combustion chamber 18 is shown in greater detail in FIG. 2 which is a view along lines 2—2 of FIG. 1. In this construction, louvres 22 are staggered peripherally about and longitudinally along primary combustion chamber 18 in a predetermined manner as indicated by arcs 40, 42, and 44 between louvres 45, 46, 48 and 50. Placement of louvres 46, 48 and 50 such that each arc 40, 42, 44 represents 15° of separation is acceptable. In another construction, the louvres are arranged in concentric rows and aligned in a number of radial bands: the openings of louvres 46, 48, 50 are aligned along radial line 51, for example.

Each louvre 22, such as louvre 52, shown in cutaway view, is a tangential slot which impels pressurized air surrounding combustor 10 in a manner indicated in phantom by dashed line 54. The impelled air cools the inner surfaces of primary combustion chamber 18 and, now heated, drives the combustion vortex and feeds combustion.

Figure 3:
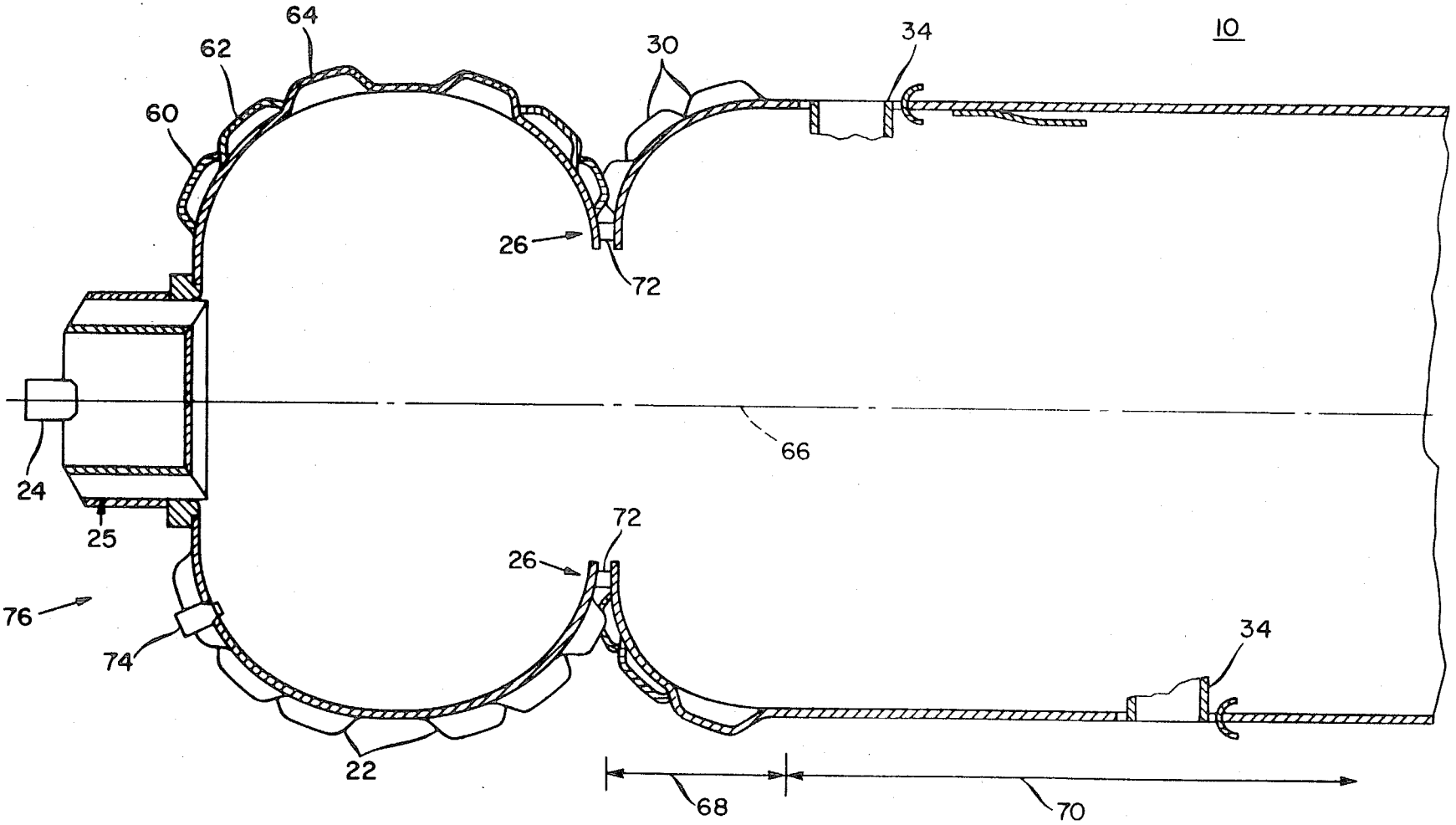
FIG. 3 is a side elevational cross-sectional view along lines 3—3 of FIG. 2.

The longitudinal distribution of louvres 22 is better shown in FIG. 3 which is a view along lines 3—3 of FIG. 2. Louvres 22 such as louvres 60, 62, 64 are longitudinally disposed proximate each other in staggered arrangement along primary axis 66 of variable residence time combustor 10.

Similarly, apertures 30 are also disposed longitudinally proximate each other in this construction. Arrow 68 represents the span of secondary zone 28 and arrow 70 represents dilution zone 32. The driving of air by louvres 22, apertures 30 and inlets 34 is described in relation to FIG. 4, infra.

In this construction waist region 26 is provided with passages 72 which drive pressurized air through waist region 26 to cool the structural material in this region. The pressurized air easily penetrates to the center of combustor 10 to provide additional oxygen for combustion remaining to be accomplished.

Variable residence time combustor 10 also includes ignitor 74 in header area 76. Header area 76 also includes air swirler 25 and fuel injector 24. Ignitor 74 is a surface discharge ignition device or spark generating device.

Figure 4:
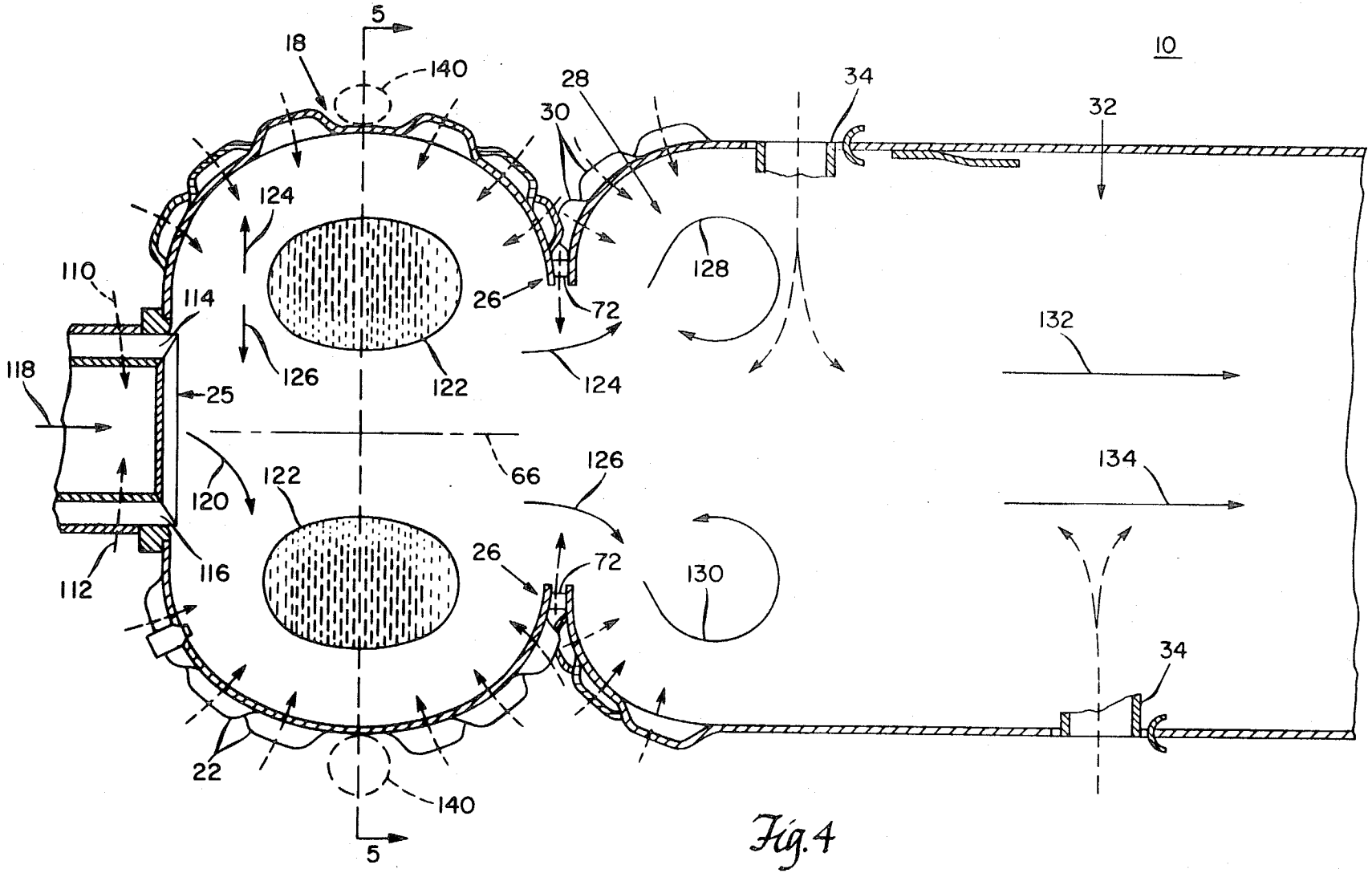
FIG. 4 is a schematic cross-sectional view of a vortex combustor according to this invention illustrating the flow of fuel and gases and their variable residence time.

Variable residence time combustors according to this invention enable adjustment of the residence time of fuel particles according to the density of those fuel particles. These variable residence time combustors control residence time within a primary combustion chamber. The operation of variable residence time vortex combustor 10 is illustrated in FIG. 4. Pressurized air is imparted with a radial swirling motion by air swirler 25; for example, pressurized air 110, 112 is directed by vanes 114, 116, respectively. Fuel 118 is entrained in air and travels as fuel-air mixture 120 about primary axis 66. A combustion vortex is established by the motion imparted to fuel-air mixture 120 by air swirler 25 and by the air impelled by louvres 22.

Pressurized air entering louvres 22 radially and longitudinally condenses the combustion vortex to create torus 122. Torus 122 is a toroidal configuration of combustion gases including trapped higher-density particles: fuel droplets travel to the outside of torus 122 as indicated by arrow 124; as each droplet is fragmented and combusted the smaller, hotter and therefore less dense particles travel inwardly in the direction indicated by arrow 126. A temperature gradient is established through torus 122 with the highest temperatures situated near primary axis 66; the lowest temperatures are situated near the surfaces of primary combustion chamber 18 which further serves to reduce the combustion heat experienced by those surfaces.

Centrifugal force drives denser particles to the outer portion of torus 122. The lightest, hottest particles escape past waist region 26 as combustion gases 124, 126 where additional pressurized air entering through passages 72 penetrates to the core of the combustion vortex to provide additional oxygen for remaining combustion. Approximately 80 percent or more of combustion is accomplished in primary combustion chamber 18; nearly all of the remaining combustion occurs in secondary zone 28.

Further combustion of the incompletely combusted gases such as carbon monoxide is accomplished in secondary zone 28. Apertures 30 impel pressurized air, again indicated by dashed lines, tangentially in a rotational direction that is opposite to air impelled by louvres 22. The rotation of combustion gases 128, 130 is impeded by the reverse air flow from apertures 30. In addition, cooling of the combustion gases commences.

Final cooling and cancellation of the combustion vortex is accomplished in dilution zone 32 to result in axial flow of the combustion gases as indicated by arrows 132, 134. The orientations of apertures 30 and inlets 34 tailor combustion gases 132, 134 so that the hottest portion of these gases falls on the appropriate area of downstream turbine blades (not shown). The majority of cooling of combustion gases within variable residence time combustor 10 is accomplished in dilution zone 32.

Figure 5:
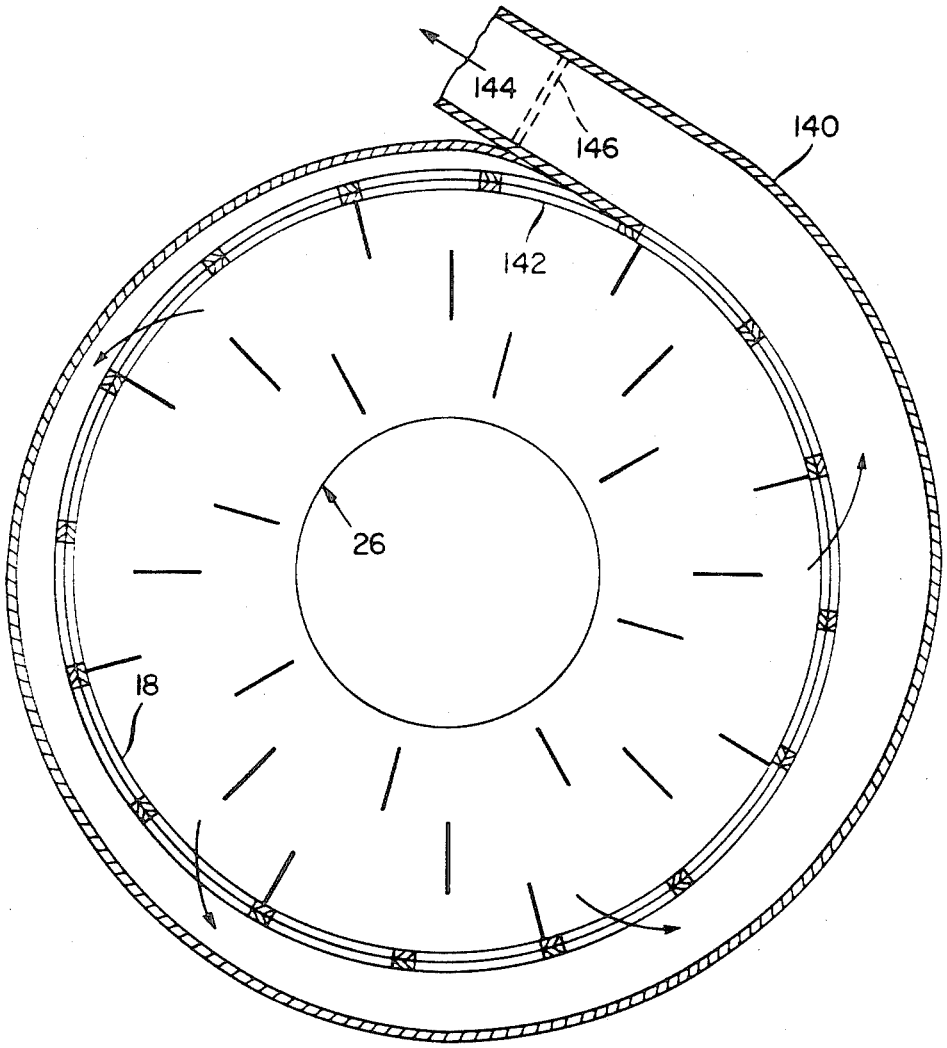
FIG. 5 is a cross-sectional view along lines 5—5 of FIG. 4 with a scroller present.

Variable residence time combustor 10 not only provides uniformly high combustion efficiency throughout its power range but also accepts a variety of fuel mixtures. When coal or coal-oil slurries are combusted, it is desirable to provide primary combustion chamber 18 with scroller 140, indicated in phantom. Ash and other by-products due to their high densities are carried by centrifugal force radially above torus 122 to opening 142 in scroller 140, shown in cross section in FIG. 5. As the combustion vortex rotates in a counterclockwise direction, the most dense particles are spun through circumferential opening 142 and travel counterclockwise through scroller 140 where they are exhausted through outlet 144. Unlike the placement of scrollers on conventional combustors, scroller 140 is radially spaced from the combustion vortex at the region of primary combustion. The by-products are thereby eliminated as soon as possible to minimize their interference with the combustion process.

The bleed of by-products through outlet 144 is continuous. Intermittent bleed is achieved by installing valve 146, shown in phantom, and operating it as desired. In another construction, opening 142 is a single discrete opening and scroller 140 is a straight tube projecting at an angle from primary conbustion chamber 18.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. A variable residence time vortex combustor comprising:

a primary combustion chamber for containing a combustion vortex;

a plurality of louvres peripherally disposed about said primary combustion chamber and longitudinally distributed along its primary axis, said louvres inclined to impel air about said primary combustion chamber to cool its interior surfaces and to impel air inwardly to assist in driving the combustion vortex in a first rotational direction and to feed combustion in said primary combustion chamber;

a second combustion chamber including a secondary zone; and said primary combustion chamber further including a narrowed waist region, interconnecting the output of said primary combustion chamber with said secondary zone for passing only lower density particles and trapping higher density particles in the combustion vortex in said primary combustion chamber for substantial combustion.

2. The vortex combustor of claim 1 in which substantially all said louvres are oriented to introduce air in the first rotational direction.

3. The vortex combustor of claim 1 in which said secondary zone includes a plurality of apertures inclined to drive air about said second combustion chamber in a second rotational direction to cool its interior surfaces, to resist the continuance of the combustion vortex beyond said waist region in the first rotational direction, and to assist in cooling combustion gases.

4. The vortex combustor of claim 3 in which said second chamber further includes a dilution zone, downstream of said secondary zone, having a plurality of inlets inclined radially inward for delivering air to further cool the combustion gases.

5. The vortex combustor of claim 4 in which air entering said second combustion chamber from said inlets of said dilution zone are directed to disperse the combustion vortex and convert airflow through said dilution zone to an axial flow.

6. The vortex combustor of claim 1 further including a plurality of passages for delivering air to cool the surfaces of said waist region and to further feed combustion.

7. The vortex combustor of claim 1 in which said primary combustion chamber further includes scrolling means, disposed circumferentially about its exterior surfaces and communicating with the interior of said primary combustion chamber, for removing ash and other by-products developed during combustion.

8. The vortex combustor of claim 7 in which said scrolling means communicates with the interior at a position in said primary combustion chamber radially spaced from the vortex axis.

9. The vortex combustor of claim 1 in which said primary combustion chamber is generally shaped as an oblate spheroid.

10. The vortex combustor of claim 1 in which said primary combustion chamber further includes means for introducing fuel into the combustion vortex.

11. The vortex combustor of claim 10 in which said means for introducing fuel includes a fuel injector and an air swirler for entraining injected fuel in air to form a fuel-air mixture deliverable to the combustion vortex.

12. The vortex combustor of claim 11 in which said primary combustion chamber further includes an ignitor for igniting the fuel-air mixture.

13. The vortex combustor of claim 12 in which said louvres are spaced about substantially the entire surface of said primary combustion chamber exclusive of the area occupied by said fuel injector, said air swirler, and said ignitor.

14. The vortex combustor of claim 1 in which said second combustion chamber is generally cylindrical.

15. The vortex combustor of claim 1 in which said louvres are inclined to drive air about said primary combustion chamber to compress said combustion vortex to establish a toroidal vortex centered about the primary axis of said primary combustion chamber.

16. The vortex combustor of claim 1 in which said primary combustion chamber is curved along said primary axis.

17. A variable residence time vortex combustor comprising:

a primary combustion chamber for containing a combustion vortex and including a fuel injector, an air swirler for entraining fuel in air to form a fuel-air mixture deliverable to the combustion vortex, and an ignitor for igniting the fuel-air mixture;

a plurality of louvres peripherally disposed about said primary combustion chamber and longitudinally distributed along its primary axis, said louvres inclined to impel air about said primary combustion chamber to cool its interior surfaces and to impel air inwardly to assist in driving the combustion vortex in a first rotational direction and to feed combustion in said primary combustion chamber;

a second combustion chamber including a secondary zone having a plurality of apertures inclined to drive air about said second combustion chamber in a second rotational direction to cool its interior surfaces, to resist the continuance of the vortex beyond said waist region in the first rotational direction, and to assist in cooling combustion gases; and said primary combustion chamber further including a narrowed waist region, interconnecting the output of said primary combustion chamber with said secondary zone, for passing only lower density particles and trapping higher density particles in the combustion vortex in said primary combustion chamber for substantial combustion.

18. The vortex combustor of claim 17 in which said second chamber further includes a dilution zone, downstream of said secondary zone, having a plurality of inlets inclined radially inward for delivering air to further cool the combustion gases.

19. The vortex combustor of claim 17 further including a plurality of passages for delivering air to cool the surfaces of said waist region and to further feed combustion.

* * * * *